United States Patent [19]

Probasco

[11] Patent Number: 4,839,928

[45] Date of Patent: Jun. 20, 1989

[54] DEVICE FOR LOWERING TOILET SEATS

[76] Inventor: Timothy C. Probasco, 5716 Plainfield Ave., Apt. 4-A, Baltimore, Md. 21206

[21] Appl. No.: 220,009

[22] Filed: Jul. 15, 1988

[51] Int. Cl.[4] ..... A47K 17/02

[52] U.S. Cl. ..... 4/251; 4/661; 4/253

[58] Field of Search ..... 4/251, 661, 237, 234, 4/242, 253; 16/83, 82

[56] References Cited

U.S. PATENT DOCUMENTS

| | | | |
|---|---|---|---|
| 4,310,947 | 1/1982 | Salerno | 16/83 |
| 4,477,933 | 10/1984 | Leckie | 4/251 |
| 4,491,989 | 1/1985 | McGrail | 4/251 |
| 4,519,105 | 5/1985 | Blanck | 4/661 |
| 4,638,515 | 1/1987 | Caputo et al. | 4/661 |
| 4,707,870 | 11/1987 | Glassco et al. | 4/661 |

*Primary Examiner*—Henry J. Recla

*Assistant Examiner*—Daniel Stein-freer

*Attorney, Agent, or Firm*—Walter G. Finch

[57] ABSTRACT

A first embodiment of a toilet seat lowering device is provided for coupling to the toilet handle of a toilet system to lower a vertically positioned toilet seat. The device consists of a tubular member which is positioned over the handle of the toilet system and a spaced wedge member for sliding between the toilet lid and seat. The sleeve and wedge member are connected together by a wire member. Upon operation of the toilet handle, the wedge slides between the toilet lid and toilet seat to lower the latter to the toilet commode. In a second embodiment of the invention, the toilet lowering device consists of a pair of holding members for holding the toilet lid and a wedge for causing a vertically positioned toilet seat to be lowered when the toilet handle is operated. A plastic connector connects the toilet handle to the toilet lowering device.

5 Claims, 3 Drawing Sheets

DEVICE FOR LOWERING TOILET SEATS

BACKGROUND AND SUMMARY OF THE INVENTION

This invention relates to toilet accessories, and more particularly to devices for closing and/or lowering toilet seats.

Many times, adults, particularly women, children, and animals accidentally fall into the toilet bowl due to the fact that the toilet lid and seat are in an elevated position.

Adults, particularly women, have complained for years that men users of toilets leave the toilet seat of a toilet in an upright position. At times, women users of a toilet have rushed into the bathroom and have fallen into the commode with a shocking splash.

Men, even though told to lower the toilet seat of the toilet after urinating, have forgotten, and the problem of women falling into the commode continues to happen. One thing most adult men users do remember to do is to flush the toilet. For children and animals it is highly undesirable for them to get in the commode.

There are several known devices for lowering of toilet seats to the commodes so that they can be sat on by the users. For example, U.S. Pat. No. 4,577,350 shows the use of an expandable automatic device for lowering a toilet seat to the commode, while U.S. Pat. No. 4,477,933 shows the use of a coiled spring for pushing a toilet seat into operative position on the commode.

It is an object of this invention to provide unique devices for lowering toilet seats into operative positions on the commode for use by users.

Another object of this invention is to provide accessories for toilets which can be used to lower toilet seats to commodes as desired.

Still another object of this invention is to provide unique devices for lowering toilet seats to commodes in order to prevent injury to a user thereof, such as an adult, a child, and an animal.

And still another object of this invention is to provide a device for automatically working while flushing a toilet.

A further object of this invention is to provide an automatic device for lowering the toilet seat in which a woman of a household will benefit when this device is utilized.

And still further object of this invention is to provide a unique toilet seat lowering device which is ideal for: newlyweds, places of business where men and women share the same restroom, families with a large number of male members, forgetful husbands, for women, but used mostly by men, and additionally the device prevents unnecessary arguments, and finally the device can be connected to toilets in minutes.

DESCRIPTION OF THE PREFERRED EMBODIMENTS

Figure 1:
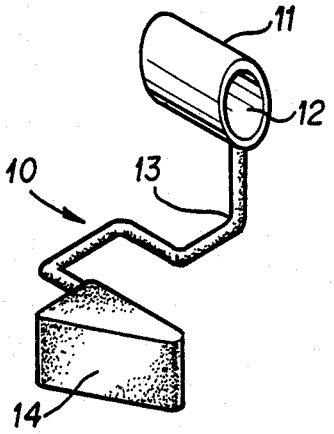
FIG. 1 is a perspective view of one embodiment of the toilet lowering device incorporating features of the invention.
Figure 2:
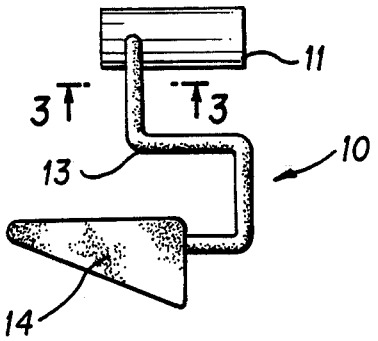
FIG. 2 is a bottom plan view of the embodiment of FIG. 1.
Figure 4:
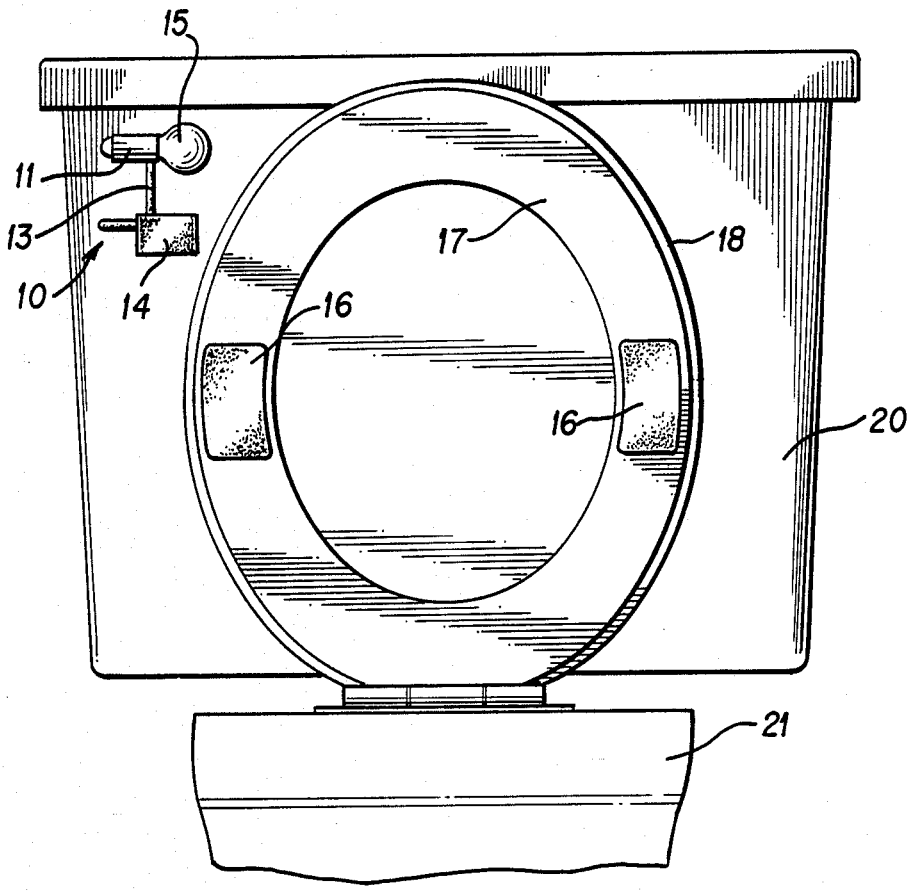
FIG. 4 is a front view of a commode with the embodiment of the invention of FIG. 1 in operative position.
Figure 5:
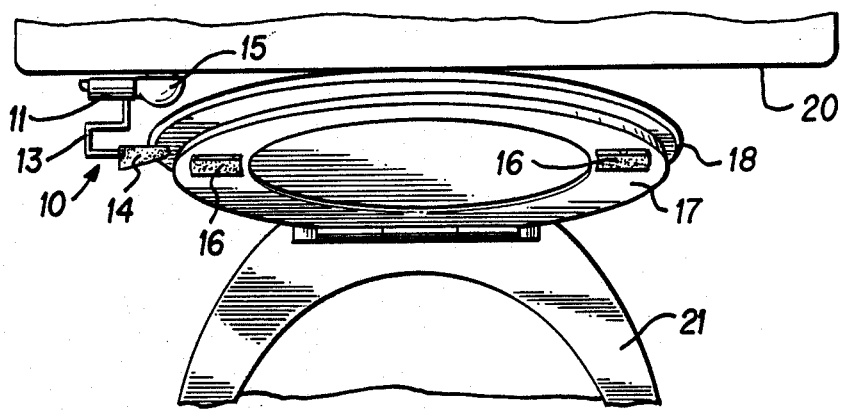
FIG. 5 is a plan view of the commode with the seat and lid in an upright position and the embodiment of the invention of FIG. 1 in position.
Figure 6:
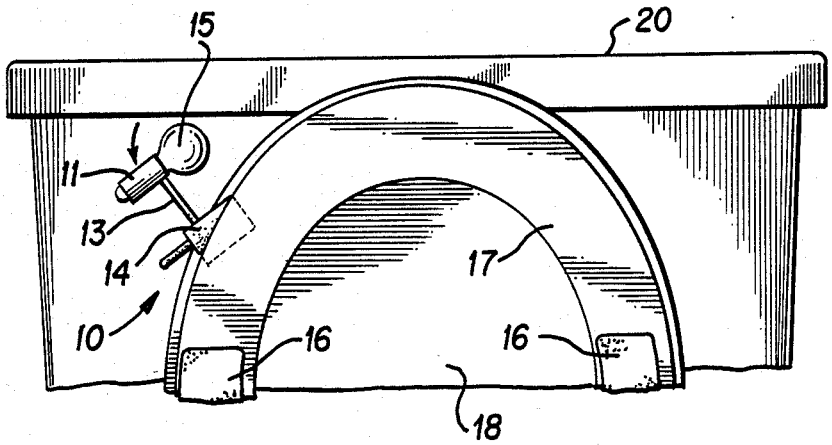
FIG. 6 is a front view of the commode with handle of the invention turned.

Referring now to FIGS. 1 and 2 of the drawings, there is illustrated the first embodiment of the handle device 10 which when coupled to the handle 15 of a toilet system 20 shown in FIG. 4 can be used effectively and efficiently to close or lower a toilet seat 17.

The toilet system 20 as shown in FIG. 4 consists of a water supply tank and a toilet bowl 21. The toilet bowl 21 has a toilet seat 17 and a lid 18. Pads 16 are placed on the underside of the toilet seat 17.

Figure 3:
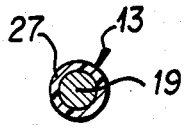
FIG. 3 is a sectional view of a plastic coated wire taken along line 3—3 of FIG. 2.

This handle device 10 is formed with a sleeve 11 having an aperture 12 extending therethrough. This sleeve 11 is located at one end of the device 10 and a wedge member 14 at the other or opposite end. A wire 13 having a number of breaks in direction is utilized to connect the sleeve 11 and wedge member 14 together as best shown in FIG. 1. The cross section of the wire 13 is shown in FIG. 3 which consists of a wire arm 19, having a plastic coating 27 formed on its external surface for protection of the wire 13.

Referring now to FIGS. 4, 5, 6, and 7, there is shown the toilet lowering device 10 in a position to lower the toilet seat 17 which is in an upright position with the toilet lowering device 10 in an operative position after the sleeve 11 has been engaged by the toilet handle 15, and the wedge 14 has been placed between the toilet lid 18 and the toilet seat 17. When the toilet handle 15 is operated, the wedge member 14 is pushed or slid between the toilet lid 18 and the toilet seat 17 to cause the toilet seat 17 to be lowered, as shown best in FIGS. 5, 6, and 7.

Figure 7:
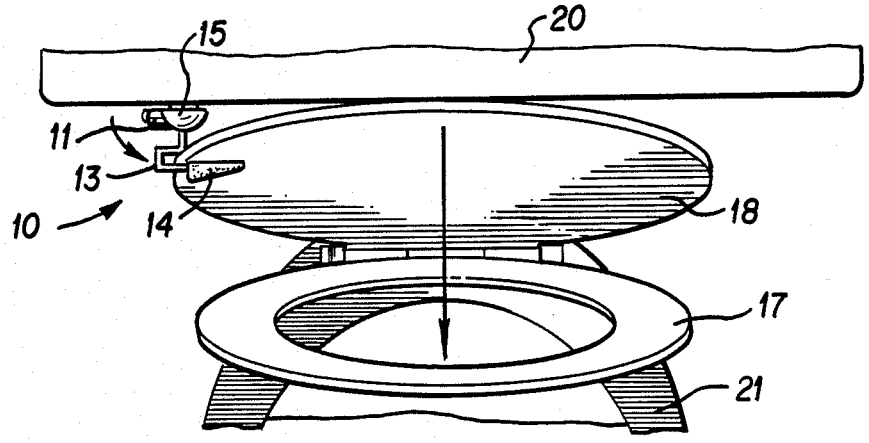
FIG. 7 is a plan view with the toilet seat dropping.
Figure 8:
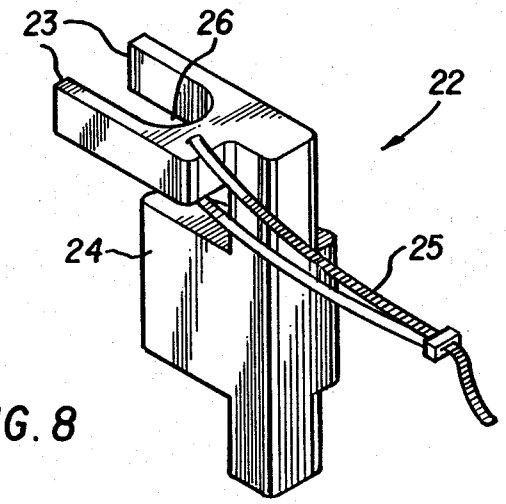
FIG. 8 is a perspective view of a second embodiment of the toilet lowering device incorporating features of the invention.

Referring now to FIGS. 8, 9, 10 and 11, there is shown a second embodiment of the handle lowering device 22 which consists of a pair of spaced holding members 23 having an aperture 26 positioned therebetween for receiving the handle 28 of the toilet system. These spaced holding members 23 are shown in FIGS. 7 and 8 and connected to a wedge 24. A plastic connector 25 is shown connected to the spaced holding members 23.

Figure 9:
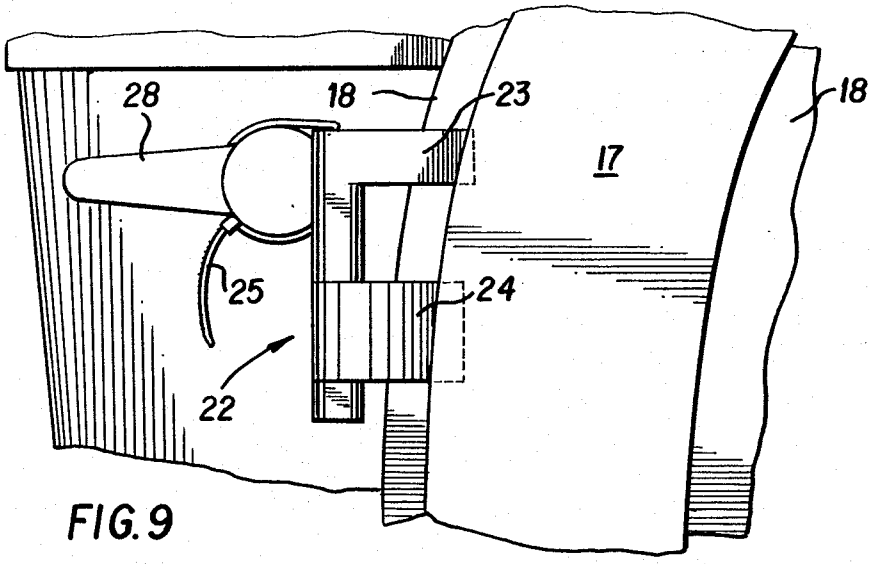
FIG. 9 is an enlarged area of the handle of the invention and commode seat.
Figure 10:
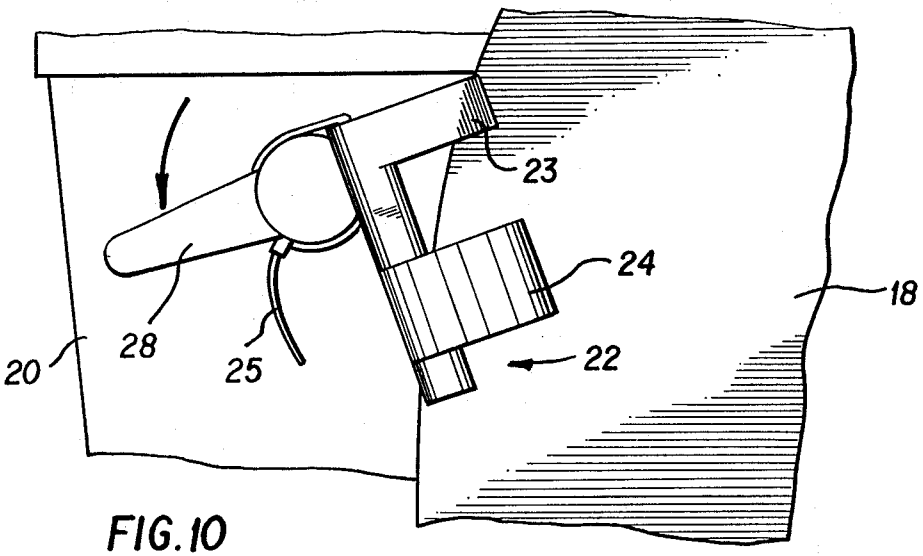
FIG. 10 is an enlarged area of the commode handle in tilt position.
Figure 11:
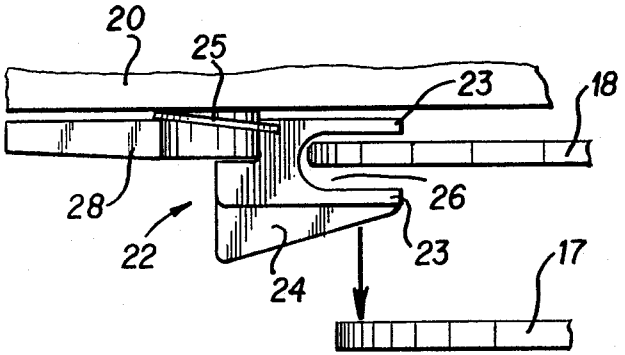
FIG. 11 is a plan view of the invention handle showing the seat dropping.

A detailed view of the toilet seat lowering device 22 is shown in FIGS. 9, 10, and 11, with the device 22 in operative position. The device is coupled to the handle 28 and with the edge of the lid 18 positioned between the holding members 23 and the wedge 24 is positioned next to the commode seat 17. The plastic connection 25 is placed over the handle 28 between the toilet bowl 20 and the handle 28.

In FIGS. 9 and 10, when required, the handle 28 is lowered to operate the toilet lowering device 22 to cause the wedge 24 and the holding members 23 to lower the seat 17, leaving the toilet lid 18 vertical.

As can be readily understood from the foregoing description to the invention, the present structure can be configured in different modes to provide a device for lowering a toilet seat.

Accordingly, modifications and variations to which the invention is susceptible may be practiced without departing from the scope and intent of the appended claims.

What is claimed is:

1. A toilet seat lowering device for use with a toilet having a seat, lid, and bowl rim, comprising, a structure having sleeve means adapted to be mounted over member the handle of a toilet, a wedge shaped member which is movably engageable between the toilet lid and toilet seat of a toilet when in their raised position, and a flexible means connecting said sleeve means, with respect to said wedge shaped member such that when said handle is rotated, said wedge shaped member is moved between said toilet lid and seat to therby cause said seat to fall onto said toilet rim.

2. A toilet seat lowering device as recited in claim 1, wherein said sleeve means comprises a cylindrical sleeve which has an aperture provided therein for receiving said toilet handle.

3. A toilet seat lowering device as recited in claim 1, wherein said means for connecting said sleeve means and said wedge shaped member is a wire.

4. A toilet seat lowering device as recited in claim 1, wherein said flexible means for connecting said sleeve means is provided with breaks in direction.

5. A toilet seat lowering device as recited in claim 1, wherein said sleeve means is provided with oppositely opposed opened sides to receive said toilet handles of different length.

* * * * *